US007412924B2

(12) United States Patent
Kümmet et al.

(10) Patent No.: US 7,412,924 B2
(45) **Date of Patent: *Aug. 19, 2008**

(54) PRINTING BLANKET ASSEMBLY FOR A BLANKET CYLINDER INCLUDING FILLER MATERIAL AT BLANKET ENDS

(75) Inventors: Andreas Kümmet, Würzburg (DE); Manfred Herrmann Liebler, Erlenbach (DE); Martin Heinz Schoeps, Güntersleben (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 470 days.

This patent is subject to a terminal disclaimer.

(21) Appl. No.: 10/538,656

(22) PCT Filed: Nov. 27, 2003

(86) PCT No.: PCT/DE03/03942

§ 371 (c)(1),
(2), (4) Date: Jun. 10, 2005

(87) PCT Pub. No.: WO2004/054808

PCT Pub. Date: Jul. 1, 2004

(65) Prior Publication Data

US 2006/0054038 A1 Mar. 16, 2006

(30) Foreign Application Priority Data

| | | |
|---|---|---|
| Dec. 16, 2002 | (DE) | 102 58 975 |
| Feb. 21, 2003 | (DE) | 103 07 382 |
| Feb. 21, 2003 | (DE) | 103 07 383 |
| Jun. 30, 2003 | (DE) | 103 29 270 |
| Nov. 21, 2003 | (DE) | 103 54 437 |

(51) Int. Cl.
*B41N 10/02* (2006.01)
*B41F 30/04* (2006.01)

(52) U.S. Cl. ..... 101/217; 101/415.1; 101/375; 101/401.1

(58) Field of Classification Search ..... 101/415.1, 101/217, 375, 376; 428/909
See application file for complete search history.

(56) References Cited

U.S. PATENT DOCUMENTS

| | | | |
|---|---|---|---|
| 2,525,003 | A | 10/1950 | Smith |
| 2,963,969 | A | 12/1960 | Sauberlich |
| 4,452,143 | A | 6/1984 | Heinemann et al. |
| 4,635,550 | A | 1/1987 | Brands et al. |

(Continued)

FOREIGN PATENT DOCUMENTS

| | | |
|---|---|---|
| DE | 43 07 320 C1 | 7/1994 |

(Continued)

*Primary Examiner*—Leslie J Evanisko
(74) *Attorney, Agent, or Firm*—Jones, Tullar & Cooper, PC

(57) ABSTRACT

A printing blanket assembly for a blanket cylinder of a rotary printing press includes a dimensionally stable support plate, and a printing blanket fastened to the outside of the support plate. A leading end of the support plate and a trailing end of the support plate are fastened to the blanket cylinder by the provision of an angled or beveled, printing blanket free end. A filler is provided between the beveled end of the support plate and the inner edge of the leading and trailing ends of the printing blanket.

25 Claims, 6 Drawing Sheets

U.S. PATENT DOCUMENTS

| | | | |
|---|---|---|---|
| 4,643,093 | A | 2/1987 | Goar et al. |
| 4,742,769 | A | 5/1988 | Zeller |
| 4,907,508 | A | 3/1990 | Patschorke |
| 4,964,338 | A | 10/1990 | Fantoni et al. |
| 5,090,319 | A | 2/1992 | Weber et al. |
| 5,125,337 | A | 6/1992 | Zeller |
| 5,178,068 | A | 1/1993 | Junghans et al. |
| 5,351,615 | A | 10/1994 | Kobler et al. |
| 5,669,306 | A | 9/1997 | Puschnerat |
| 5,732,630 | A | 3/1998 | Puschnerat et al. |
| 5,749,298 | A | 5/1998 | Castelli et al. |
| 5,934,194 | A | 8/1999 | Puschnerat et al. |
| 6,779,449 | B1 | 8/2004 | Hoffmann et al. |

FOREIGN PATENT DOCUMENTS

| | | | |
|---|---|---|---|
| DE | 195 21 645 | A1 | 1/1997 |
| DE | 195 43 584 | C1 | 7/1997 |
| DE | 195 47 917 | A1 | 7/1997 |
| DE | 43 07 320 | C2 | 10/1998 |
| FR | 1367860 | | 6/1964 |

Fig. 6
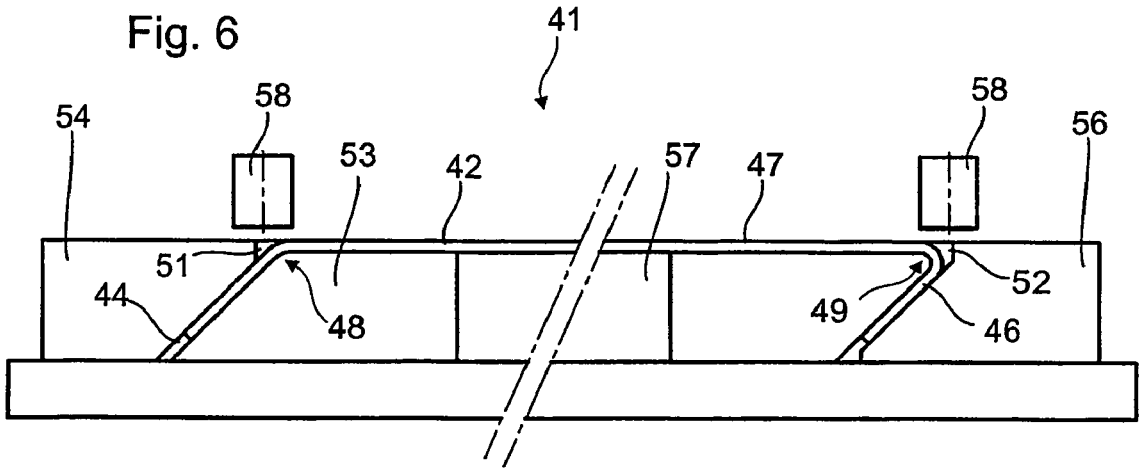
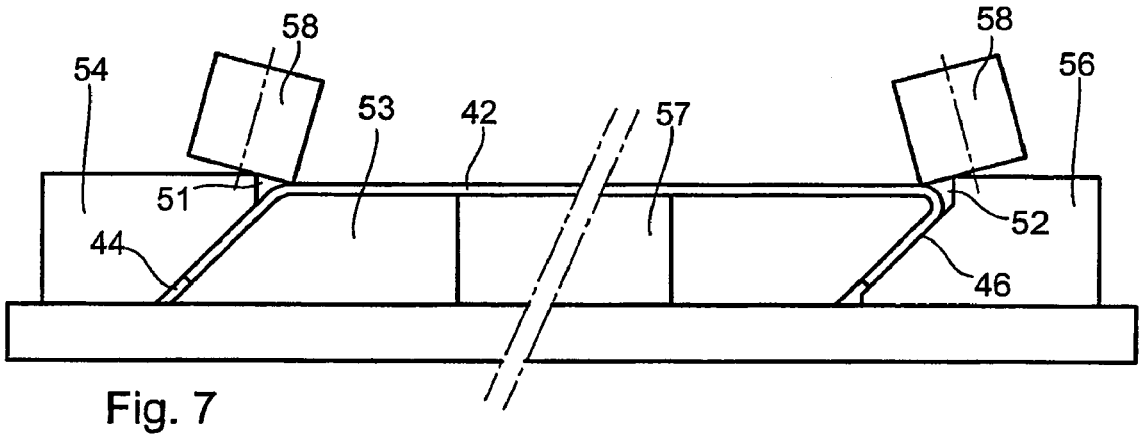
Fig. 7
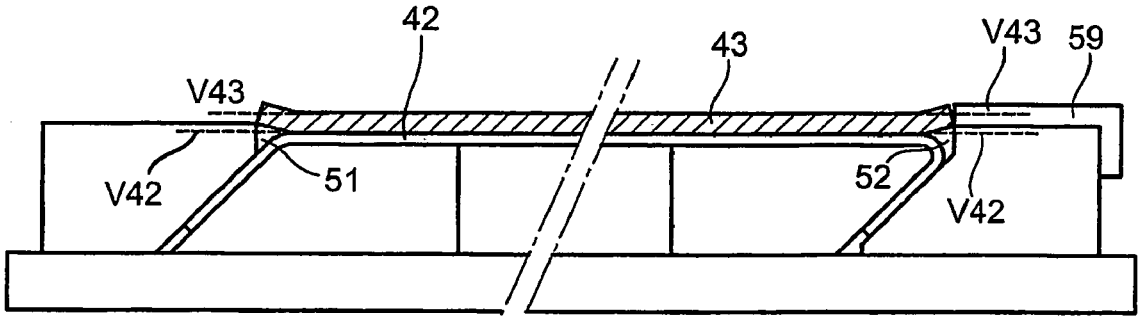
Fig. 8

PRINTING BLANKET ASSEMBLY FOR A BLANKET CYLINDER INCLUDING FILLER MATERIAL AT BLANKET ENDS

CROSS-REFERENCE TO RELATED APPLICATIONS

This application is the U.S. national phase, under 35 USC 371, of PCT/DE2003/003942, filed Nov. 27, 2003; published as WO 2004/054808 A1 on Jul. 1, 2004 and claiming priority to DE 102 58 975.5, filed Dec. 16, 2002; to DE 103 07 382.5, filed Feb. 21, 2003; to DE 103 07 383.3 filed Feb. 21, 2003; to DE 103 29 270.5, filed Jun. 30, 2003 and to DE 103 54 437.2 filed Nov. 21, 2003, the disclosures of which are expressly incorporated herein by reference.

FIELD OF THE INVENTION

The present invention is directed to a printing blanket unit or assembly for a printing blanket cylinder, as well as methods for producing such a printing blanket. The assembly includes a support plate and a blanket. The support plate has beveled or angled ends. A filler is used at a juncture of the beveled ends and the blanket.

BACKGROUND OF THE INVENTION

Printing blanket assemblies or units are fastened on a printing blanket cylinder of a printing press and are used in offset printing for transferring the print image from the forme cylinder to the web of material to be imprinted. To provide the required mechanical strength for the printing blanket unit, a support plate which is made, for example, of sheet steel or sheet aluminum, is employed. A printing blanket, which can be configured in the manner of a rubber blanket, for example, is fastened on the outside of the support plate. Folded or angled plate end legs, which are free of the printing blanket, are provided at the leading end and/or the trailing end of the support plate. These legs are used for fixing the printing blanket unit in place on the printing blanket cylinder. These legs can be inserted, for example, into a slit which is provided in the printing blanket cylinder and can be fixed in place in the slit to secure the blanket assembly to the blanket cylinder.

A problem in connection with known printing blanket units is that the printing blanket does not cover the support plate seamlessly. A gap frequently remains between the leading and the trailing ends of the printing blanket and the support plate. No printing ink can be transferred, in the area of the gap, to the web of material to be imprinted. Furthermore, the print image is of reduced quality at the edges of the printing blanket in the direction toward the gap. Therefore, several solutions are known in the prior art, by the use of which solutions the disadvantages caused by the provision of a gap between the ends of the printing blanket have attempted to be avoided.

A printing blanket unit is known from DE 195 47 917 A1. The two ends of the printing blanket overlap each other with a positive connection in order to reduce the gap that typically is located between the ends of the printing blanket.

A printing blanket unit is known from DE 195 21 645 A1. A slide is arranged between the two legs of the support plate. In this prior art arrangement, the outward pointing end of the slide is connected with a filler element. The gap between the ends of the printing blanket is closed by the filler element.

A printing blanket unit is known from DE 195 43 584 C1. In this device the printing blanket is put together from a plurality of layers. A top layer of the plurality of layers covers the front areas of the layers underneath it and in this way forms a protrusion, by the use of which protrusion the gap at the ends is reduced.

U.S. Pat. No. 5,749,298 discloses a printing blanket unit with a support plate, whose ends are folded. The printing blanket, which is arranged on the support plate, is sealed at the front.

U.S. Pat. No. 4,635,550 discloses a printing blanket unit with a printing blanket arranged on a support plate. A support element is arranged in the groove in the support plate, which support element supports the projecting end of the printing blanket.

U.S. Pat. No. 2,525,003 shows a device for producing a printing blanket unit.

U.S. Pat. No. 4,643,093 discloses a printing plate with a reinforced end and an associated device.

SUMMARY OF THE INVENTION

The object of the present invention is directed to the provision of a printing blanket unit for a printing blanket cylinder, as well as methods for producing such a printing blanket unit.

In accordance with the present invention, this object is attained by the provision of a printing blanket unit for use on a blanket cylinder of a rotary printing press. The printing blanket unit includes a dimensionally stable support plate and a resilient printing blanket supported by the support plate and fastened to its exterior. The support plate has at least one angled end leg that is used to attach the support plate to the blanket cylinder. This angled leg is not covered by the printing blanket. A filler material is arranged between the juncture of the start of the angled end of the support plate and the end of the printing blanket.

An advantage of the blanket printing unit or assembly, in accordance with the present invention, lies, in particular in that the inside edge of the leading and/or trailing end of the printing blanket protrudes at some distance past the fold line which defines the start of the underlying support plate of the associated leg. The gap between the ends of the printing blanket, when the printing blanket unit is placed on the blanket cylinder, is reduced by this protrusion. It is easily within the scope of the subject invention to select the length of the protrusion to be sufficient so that in the installed position, the two ends of the printing blanket come into contact with each other. Because of the provision of the fold in the support plate, the protruding ends of the printing blanket are not supported from below by the support plate. In the past, no pressure, between the printing blanket and the web of material to be imprinted, could be built up in the area of the printing blanket protruding ends without further assistance. To solve this problem it is proposed, in accordance with the present invention, to arrange a support element between the fold of the support plate and the inside of the printing blanket for the purpose of supporting the protrusion. As a result, any pressure forces are then transferred to the support plate via the support element, so that the printed image can be printed properly on the web of material to be imprinted by use of the area of the protruding ends of the printing blanket. It is basically without importance whether a support element for supporting the protrusion is provided at both ends of the printing blanket or only at one end of the printing blanket.

A multitude of fastening solutions are possible for use in fastening the support elements on the printing blanket unit. In accordance with a preferred embodiment of the present invention, the support elements are fastened on the support plate in the area of the plate fold and/or on the inside of the printing blanket by a material-to-material contact, such as in particular by being glued on or by being applied by vulcanization.

The support elements can be produced in a particularly simple manner if they are made using the same material as is used for the printing blanket, such as, for example, of rubber, or of the same material as the support plate, such as, for example, of metal. It is then conceivable, in particular, to form the support elements as one piece together with the printing blanket or with the support plate.

When producing the support elements, it is moreover within the scope of the present invention for the support elements to be connected, by a material-to-material contact, with a sub-structure layer which may be arranged between the printing blanket and the support plate, which connection, in this way, continuously envelops the support plate, starting at the two folds. By the use of the sub-structure layer, it is possible to additionally affect the properties of the printing blanket unit, in particular with respect to hardness and true running. Rubber or a similar elastomeric material are particularly suitable as the material for use in producing the sub-structure layer.

Printing blanket units, which have a minimal gap, can be produced, in a relatively uncomplicated way, by using the production method in accordance with the present invention. A processing cylinder can be utilized for performing the present method, whose shape, and in particular whose diameter and whose fastening devices, for use in fastening the support plate, substantially correspond to the actual printing blanket cylinder with which the printing blanket unit or assembly will later be used in the printing press. The initially un-layered support plate is first fastened on this processing cylinder by utilization of the support plate's folded end legs and, in this way, takes up a position which corresponds to the subsequent position it will take, following the mounting on the printing blanket cylinder.

Subsequent to the fastening of the support plate on the processing cylinder, the gap which exists between the oppositely located folds or fold areas of the support plate, is filled with a support material, such as, for example, a curable rubber material. The two folds or fold areas of the support plate are effectively connected by material-to-material contact in this way.

Following this filling of the support plate gap area, the printing blanket is fastened on the support plate in such a way, such as, for example, by being glued on or by being applied by vulcanization, that one end of the printing blanket protrudes some distance past the fold area of the associated leg. In this way, the protrusion of the end of the printing blanket then rests on the support material and is supported from below by the support material.

To be able to ultimately take the printing blanket unit off the processing cylinder, the support material is cut to form two support elements. This cutting can be done either prior to, or after the fastening of the printing blanket on the support plate. This can take place, for example, in that the support material can be cut through by the use of a sharp cutting instrument. In this way, the two lateral faces of the oppositely located support elements, which are formed by the separating process, have a shape wherein, following the mounting of the printing blanket unit on the printing blanket cylinder, the support elements, having the complementary shape, are located at a short distance opposite each other or come into contact with each other.

One preferred method variation is employed to be able not only to assure the optimal support of the protrusion at the end of the printing blanket, but also to minimize, or to eliminate, any gap between the two ends of the printing blanket. With this method, the customary printing blankets are used which blankets, prior to the application of the printing blanket to the support plate, have a flat shape, such as, for example, a rectangular shape. By applying the printing blanket to the support plate, a gap is formed between the two facing lateral faces situated at the oppositely located ends of the printing blanket when employing these flat printing blankets. This gap is filled with a suitable sealing material, such as, for example, a curable rubber material. In order to be able to remove the printing blanket unit from the processing cylinder, the sealing material, after it has been sufficiently cured, is then cut through. The lateral faces of the oppositely located support elements, which are formed by the cutting process, thus have a shape wherein, following the mounting of the printing blanket unit on the printing blanket cylinder, the ends of the printing blanket, with this complementary shape, are located spaced at a short distance opposite each other, or may come into contact with each other.

In order to achieve the best possible true running of the blanket cylinder, it is particularly advantageous if the sealing material is shaped, such as, for example by being ground, prior to or after being cut in order to form a cylindrical circumferential surface.

The sealing material and the support material are preferably cut simultaneously in order to assure an optimal positive connection between the oppositely located ends of the printing blanket unit, when mounting the printing blanket unit on the printing blanket cylinder.

Alternatively to the use of flat printing blankets, the use of hose-like or sleeve-like printing blankets is also within the scope of the present invention. Because of their hose-like or sleeve-like shape, with these printing blankets the connection of the ends is omitted, such as is required in connection with the previously discussed, preferred method variation for use in connection with flat printing blankets, for eliminating the gap between the ends of the printing blanket. For example, for fastening the hose-like or sleeve-like printing blankets, it is conceivable that, following the arrangement of the printing blanket on the underlying support plate, a suitable adhesive is pressed into the gap between the printing blanket and the support plate. Channels or recesses in the support plate can be provided for this. Alternatively, the use of adhesive materials, which can be cured by the use of temperature or by light radiation is also conceivable, so that the hose-like or sleeve-like printing blanket can initially be pulled onto the support plate and thereafter the adhesive, which is applied to the support plate, is cured by temperature or light radiation. As soon as the hose-like printing blanket has been fixed in place on the support plate, it can be cut by a suitable cutting process in order to be able to now remove the support plate from the processing cylinder.

BRIEF DESCRIPTION OF THE DRAWINGS

Preferred embodiments of the present invention are represented in the drawings and will be described in what follows.

Shown are in.

DESCRIPTION OF PREFERRED EMBODIMENTS

Figure 2:
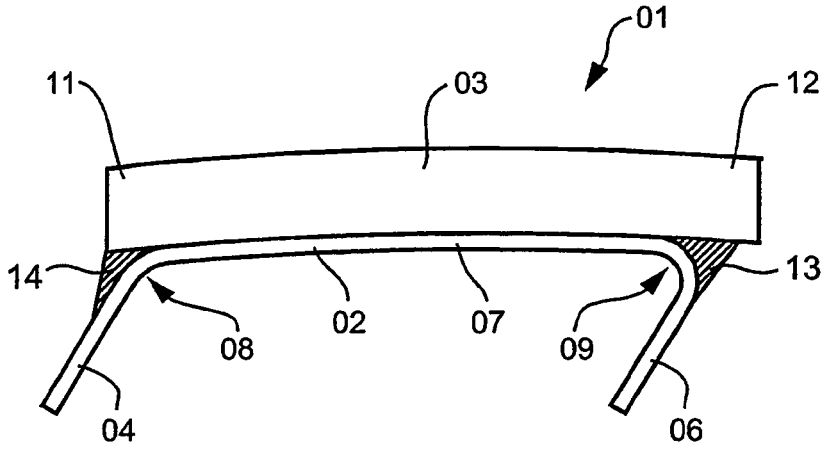
Figure 3:
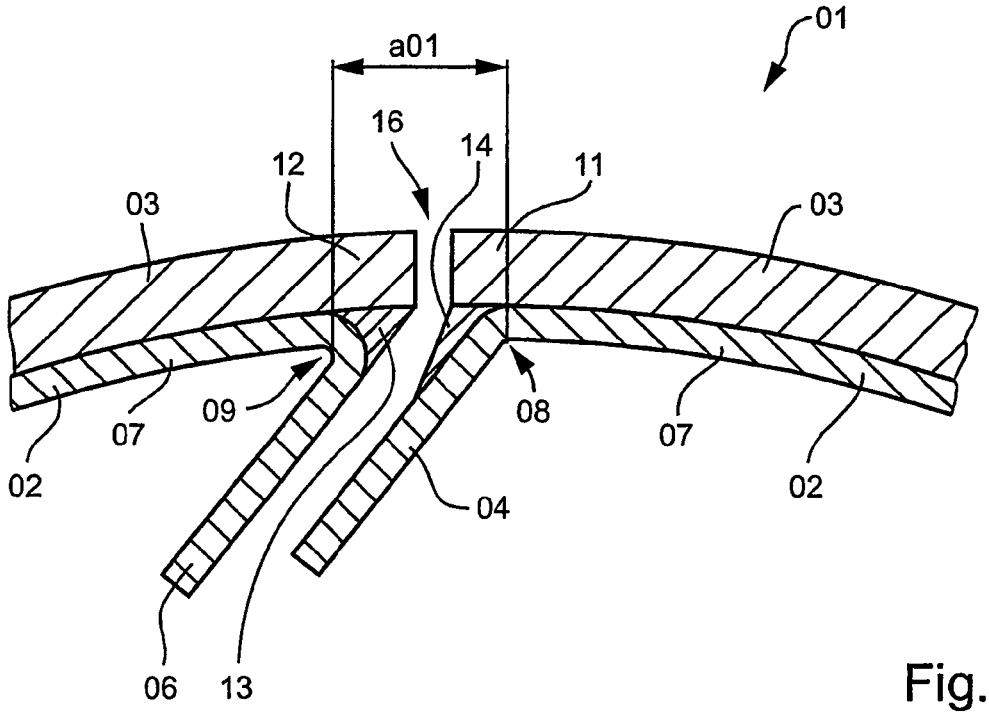
Figure 4:
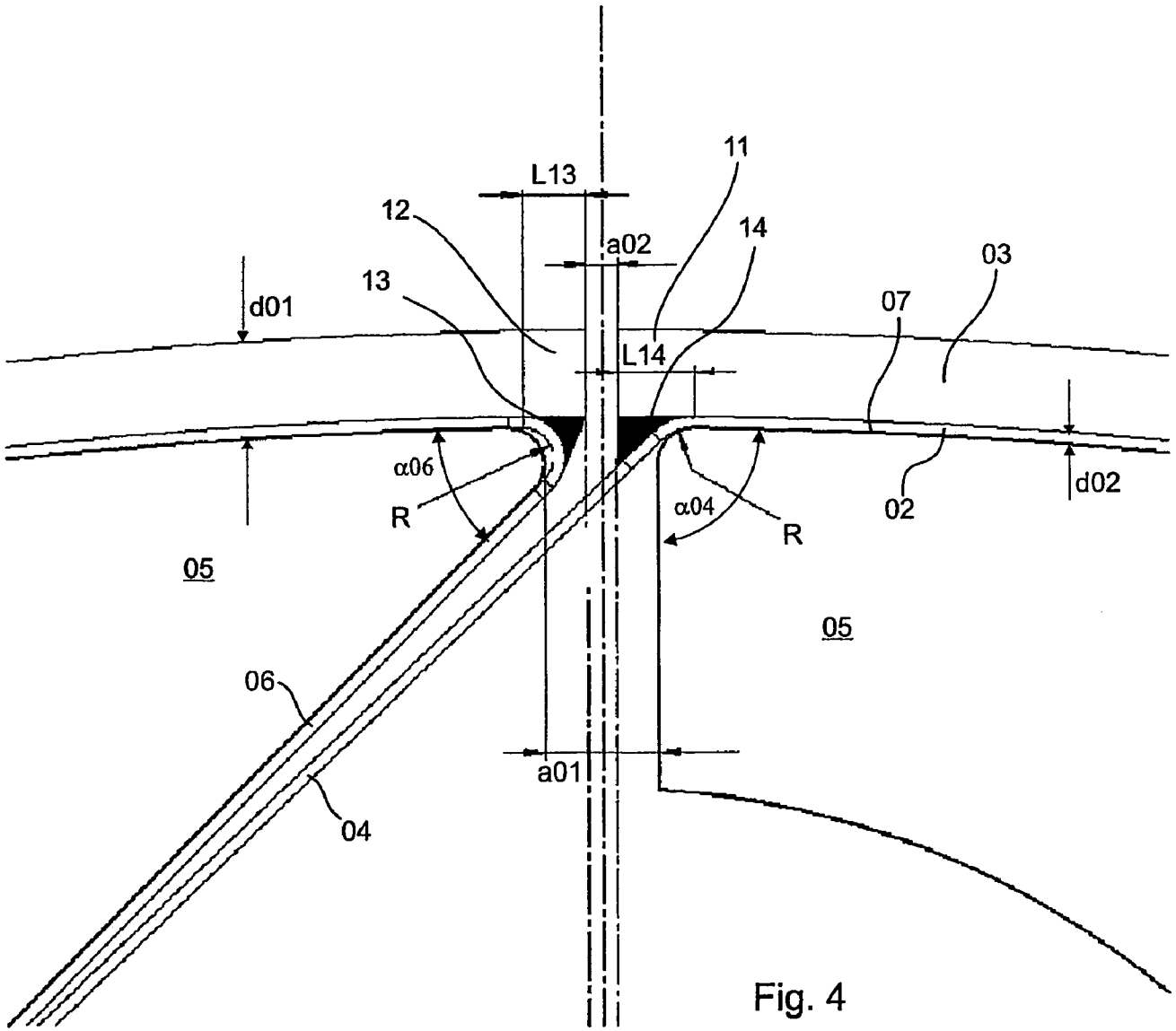

A printing blanket unit in accordance with the present invention and as represented at 01, 17, or 41 in FIG. 1 to FIG. 12, and whose thickness d01, as seen in FIG. 4 is, for example, 1.6 mm, consists of a dimensionally stable support plate 02, 18 or 42, respectively, of a thickness d02, as seen in FIG. 4, of approximately 0.2 mm to 0.5 mm, and of a printing blanket 03, 19 or 43, respectively, fastened on the support plate 02, 18, 42. The support plate 02, 18 or 42 is made of metal, such as, for example, sheet steel or sheet aluminum. The printing blanket 03, 19 or 43 can be embodied, for example, in the manner of a rubber blanket 03, 19, 43 respectively, and in particular can be fabricated several layers of different materials.

The leading and trailing printing blanket unit securement legs 04 and 06, 21 and 22, or 44 and 46 respectively, which are free of and are not overlaid by the printing blanket, are folded downward at the leading and at the trailing end of the support plate 02, 18, 42 by the use of a folding machine which is not shown, so that the now angled or folded legs 04, 06, 21, 22, 44, 46 can later be used for fastening the printing blanket unit on a printing blanket cylinder 05, as shown in FIG. 4. The folded leg 06, 21, 46, which is situated at the plate leading end, together with a center element 07, 35, 47 of the support plate 02, 18, 42, respectively, following it, forms an acute opening angle $\alpha$06, in particular of 30 to 60 degrees, and preferably of 40 to 50 degrees. The folded leg 04, 22, 44 which is situated at the plate trailing end, together with the adjoining support plate 02, 18, 42, has an opening angle $\alpha$04 of 45 to 150 degrees, and in particular of 80 to 100 degrees. In a preferred embodiment of the invention, the angle size $\alpha$04 is from 120 to 150 degrees. The center element 07, 35, 47 of the support plate 02, 18, 42 respectively, which is completely covered by the printing blanket 03, 19, 43, respectively and which is facing toward the outside, extends between the legs 04 06, 21, 22, or 44 and 46, respectively. Fold lines or fold zones 08 and 09, or 27, 28, or 48 and 49 are located at, and extend at the transition between the center element 07, 35, 47 on the one side and the legs 04, 22, 44, or 06, 21, 46 on the other side.

Figure 1:
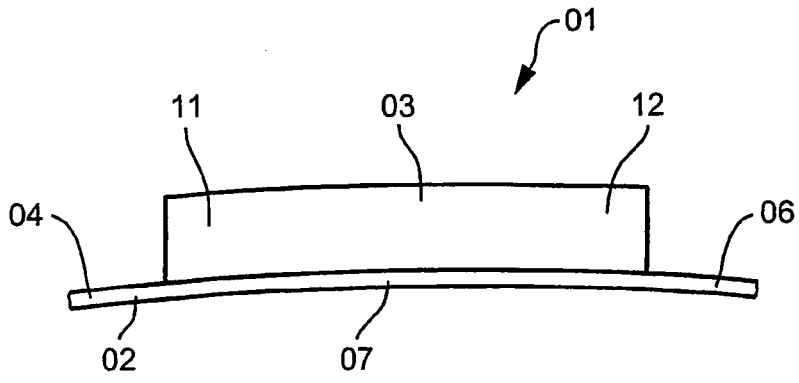
FIG. 1, a first preferred embodiment of a printing blanket unit, in accordance with the present invention, in a first production phase, in FIG. 2, the printing blanket unit shown in FIG. 1, in a second production phase, in FIG. 3, the printing blanket unit shown in FIG. 1 and FIG. 2 and in a third production phase, in FIG. 4, a second preferred embodiment of a printing blanket unit in accordance with the present invention, in FIG. 5, a third preferred embodiment of a printing blanket unit in a partial cross sectional view, in FIGS. 6 and 7, first and second embodiments of a production method for producing a printing blanket unit in accordance with the present invention, in FIG. 8, a preferred embodiment of the printing blanket unit made in accordance with the production method of FIG. 7 and with thickened ends, in FIGS. 9 to 11, preferred embodiments of further production methods for a printing blanket unit, and in FIG. 12, a preferred embodiment of the printing blanket unit in accordance with FIG. 3 with thickened ends.

In the printing blanket unit production phase, which is represented in FIG. 1, the support plate 06, as well as the printing blanket 03, are both configured as being approximately flat, so that the printing blanket 03 can be fastened on the support plate 02 free of tension and deformation. To this end, the printing blanket 03 can be glued and/or can be vulcanized to the support plate 02 using any suitable process.

The legs 04 and 06, which are free of the printing blanket 03, are folded downward in a folding machine, in a procedure which is not specifically depicted, and the result is shown in FIG. 2.

The folds 08 and 09 or fold lines or fold zones are produced in the folding machine in such a way that the result is that each of the two ends 11 and 12 of the printing blanket 03 protrude some distance past their respective one of the folds 08 and 09. A resultant space between the protruding ends 11 and 12 of the printing blanket 03 on the one hand, and the support plate 02 on the other, is filled with a suitable filler material 13, 14, which filler material 13, 14 is also called a support element 13 and 14. The filler material 13 and 14 can be provided, for example, by applying a curable rubber material, for example.

The filler material 13, 14 is preferably deformable and/or flowable while it is being applied.

A portion of the resultant printing blanket unit 01 is shown, in its installed position, in FIG. 3. It can be seen in FIG. 3 that in the installed position, the two support plate legs 04 and 06 extend at complementary angles to, and parallel to each other, so that they can be fastened together in a slit in a printing cylinder, which is not specifically represented. Because of the protrusion of the ends 11 and 12 of the printing blanket 03. A width of the resultant gap 16 between the ends 11 and 12 of the printing blanket 03 is minimized. It is possible, for example, to minimize the width of the gap 16 to a width of less than 0.5 mm.

The distance between the folds or fold lines or fold zones 08, 09 substantially corresponds to the distance a01 of the opening in the cylinder surface and is less than 3 mm. In particular, the opening a01 is less than 2.0 mm.

Because of the support of the protruding ends 11 and 12 of the printing blanket 03 by the filler material 13 and 14, a suitable print transfer from the printing blanket 03 to a web of material to be imprinted is achieved in this area defined by the blanket protruding ends 11 and 12.

As represented in FIG. 4, a distance a02 between the oppositely located ends 11, 12 of the printing blanket 03 is 0.2 mm to 0.8 mm, and preferably is 0.3 mm to 0.7 mm. In a particularly preferred embodiment, the distance a02 is 0.4 mm to 0.6 mm, and in particular is 0.5 mm.

The fold 08 of the trailing end leg 04 has a radius R of 0.6 mm to 1.2 mm, and in particular of 0.8 mm, as shown in FIG. 4.

The fold 09 of the leading end leg 06 has a radius R of 0.3 mm to 0.7 mm, and in particular of 0.5 mm, also as shown in FIG. 4.

A length L13, L14 of each respective support element 13, 14 in the circumferential direction is 0.4 mm to 1.0 mm, and in particular is from 0.1 mm to 1.3 mm. In a preferred embodiment of the present invention, a length L13, L14 of each of the support elements 13, 14 is 0.7 mm.

As represented in FIG. 4, the filler material 13, 14 can be formed in different shapes. For example, the filler material 13 has an acute angle, while the filler material 14 is shaped generally right-angled.

The measurements described for FIG. 4 can be substantially transferred to all of the embodiments of the present invention, which are represented in all of the drawing figures.

Figure 5:
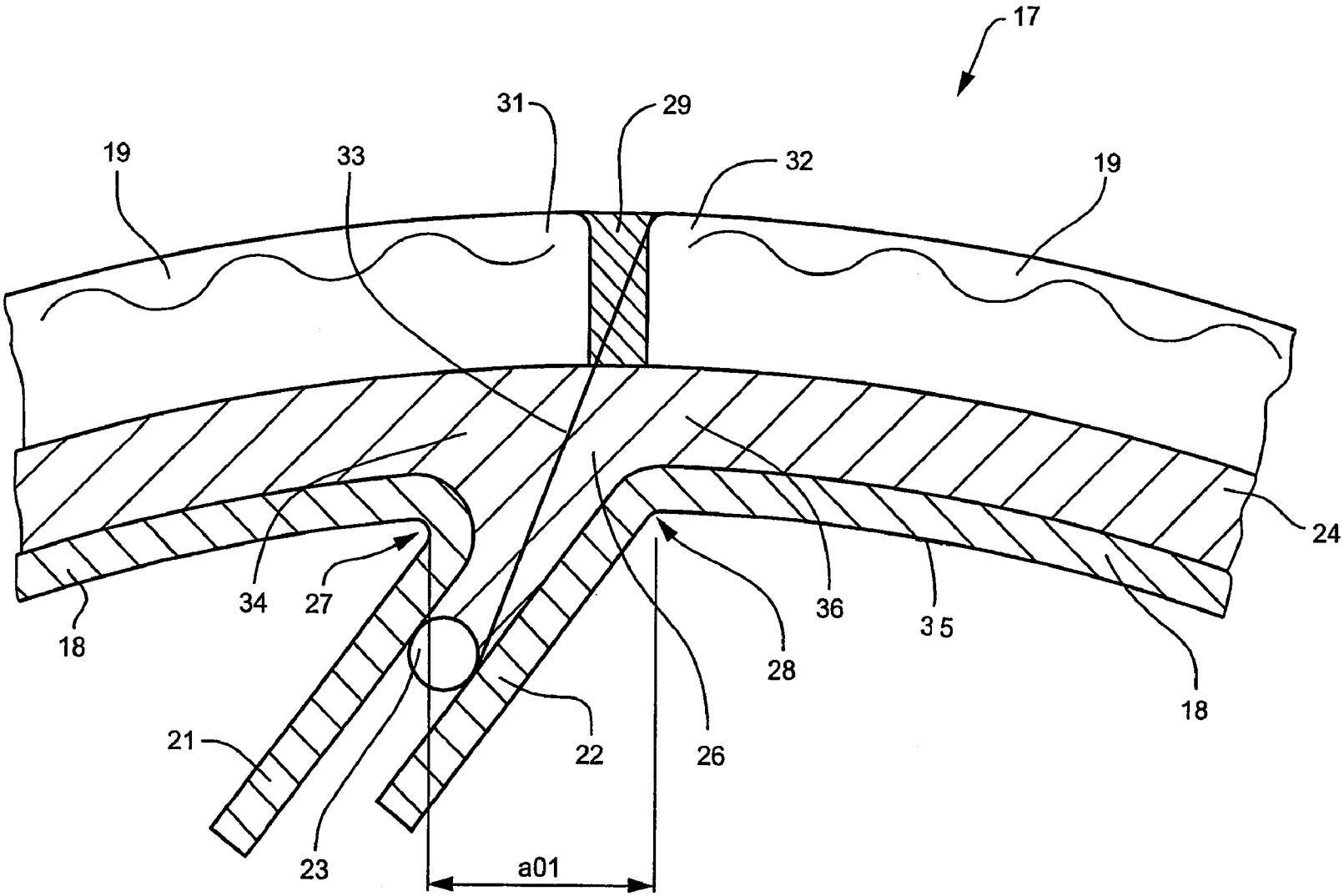

A third embodiment of a printing blanket unit, in accordance with the present invention, is represented in FIG. 5. This printing blanket unit also has a support plate 18 of sheet steel and a printing blanket 19 of rubber. To produce the printing blanket unit, first the support plate 18 is fastened, by utilization of its legs 21 and 22, on a processing cylinder, whose shape corresponds to the shape of the printing blanket cylinder in the printing press on which the printing blanket unit is ultimately to be fastened. Following this placement, a sealing element 23 is inserted into the gap 26 between the legs 21 and 22 and is used for closing the gap 26 at the bottom of the gap 26. Thereafter, a liquid elastomer material is applied to the outside of the support plate 18 in such a way that the support plate 18 is enclosed in a continuous sub-structure layer 24 of this liquid elastomer. In the area of the oppositely located legs 21 and 22 of the support plate, the sub-structure layer 24 fills the gap 26 which is the space between the oppositely located folds or fold lines or fold zones 27 and 28.

Subsequently, a suitable printing blanket 19 is fastened on the sub-structure layer 24, by being, for example, applied by vulcanization. The gap 26, which continues between the ends 31 and 32 of the printing blanket 19, is closed by filler material, here also called sealing material 29, which, for example, may be a curable elastomeric material, and which is thereafter ground at the outside for producing a uniform cylindrical outer surface.

At the end of the process, the sealing material 29 and the sub-structure layer 24 are cut through along a cutting line 33, as seen in FIG. 5, so that the printing blanket unit can be removed from the processing cylinder and can subsequently be mounted on a printing blanket cylinder. Separate support elements 34 and 36 are formed by the separation of the sub-structure layer 24, which separate support elements 34 and 36 support the respective ends 31 and 32 of the printing blanket 19 from below. In the course of mounting the printing blanket unit on a printing blanket cylinder, the lateral faces of the support elements 34 and 36, which lateral faces were formed by the cut along the cutting line 33, can come into a positively connected contact with each other.

FIGS. 6 to 8 show preferred embodiments of a different production method for the production of a printing blanket unit similar in structure to the one depicted in FIG. 3.

As previously described, at least one end of the support plate 42 is folded. The support plate 42 is now placed on a base body 53 of a device 41 which device 41 is provided with at least one slide 54, 56, which slide or slides 54, 56 will be described in what follows. At least one of the slides 54, 56 is movable with respect to the base body 53 and/or with respect to the other slide 56, 54. The geometry of this base body 53 is matched to the geometry of the support plate 42. Both slides 54, 56 of the device 41 are initially open. The support plate 42 is now adjusted to the required cylinder circumference or to the required folding measure by the use of an adjustment mechanism 57. Both slides 54, 56 are closed. The filler material 51, 52 is subsequently poured or is pressed into the gap in a positively connected manner. Depending on the shape of the slides 54, 56, a flat sub-structure, such as one which is flush with the support plate 42, or a raised sub-structure is attained. The slides 54, 56 act as molds 54, 56 for the filler material 51, 52. In this case, at least one of the filler materials 51, 52 protrudes in the radial direction past a virtual extension V42 of the exterior of the support plate 42. Now the filler material 51, 52 is pulled or is ground to be flush by the use of a further device 58. Subsequently the printing blanket 43 is applied to the support plate 42 and to the filler material 51, 52. This can be performed with the aid of a stop 59, which can be placed against an end of the printing blanket 43, as seen in FIG. 8. At the end of the production process, the slides 54, 56 are opened and the printing blanket unit is vulcanized. This vulcanization can be performed inside the device 41, and can also be accomplished outside of the device 41.

Figure 9:
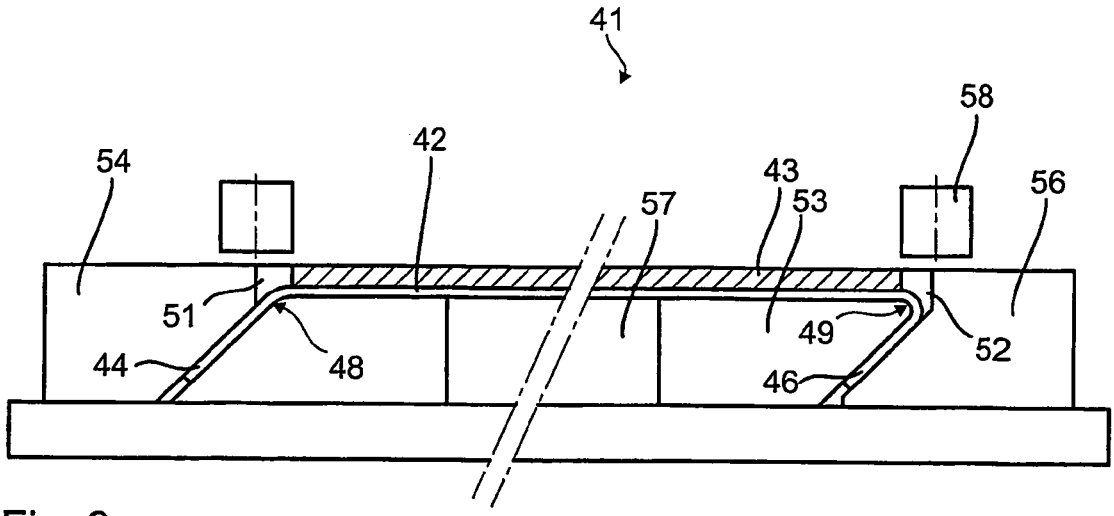
Figure 10:
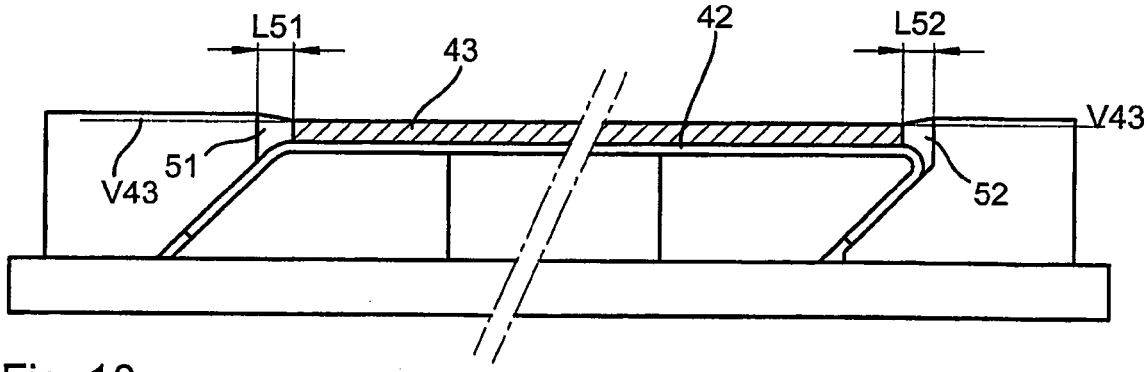

FIGS. 9 and 10 show a particularly preferred production method for making a further printing blanket unit. This embodiment makes it possible to close or to reinforce a groove of a cylinder.

In the method shown in FIGS. 9 and 10, the filler material 51, 52 extends in a virtual extension V43 of the exterior of the printing blanket 43 in the longitudinal direction, i.e. in the circumferential direction of the printing blanket 43. In this case, the filler material 51, 52 can protrude, in the longitudinal direction, past one end 61, 62, as well as past both ends 61, 62 of the printing blanket 43. In the radial direction, the filler material 51, 52 can protrude at least partially past the virtual extension V43 of the exterior of the printing blanket 43, as may be seen in FIGS. 10 and 11.

This embodiment is accomplished by the following production method. As previously described, at least one end of the support plate 42 is folded. The printing blanket 43 is then applied to the support plate 42. In this case, it is unimportant whether or not the printing blanket 43 has already been vulcanized. Subsequently, the slides 54, 56 are closed. Now, the filler material 51, 52, for use in closing and reinforcing a groove, is pressed or is poured in. Depending on how the slide 54, 56 is configured, a corresponding shape of the filler material 51, 52 is attained. Thereafter, the filler material 51, 52 is shaped to the exact size. Depending on the needs, the vulcanization process can subsequently take place either inside of or outside of the device 41.

The two above-described production methods thus differ in that, in the embodiments in accordance with FIGS. 6 to 8, the filler material 51, 52 is arranged between the support plate 42 and the printing blanket 43, wherein the filler material 51, 52 is first arranged on the support plate 42 and then the printing blanket 43 is put in place. In the embodiment in accordance with FIGS. 9 to 11, the support plate 42 is connected with the printing blanket 43, and the filler material 51, 52 is then introduced. An exterior surface of the filler material 51, 52, which is arranged on the exterior in the radial direction, is not covered by the printing blanket 43.

Figure 11:
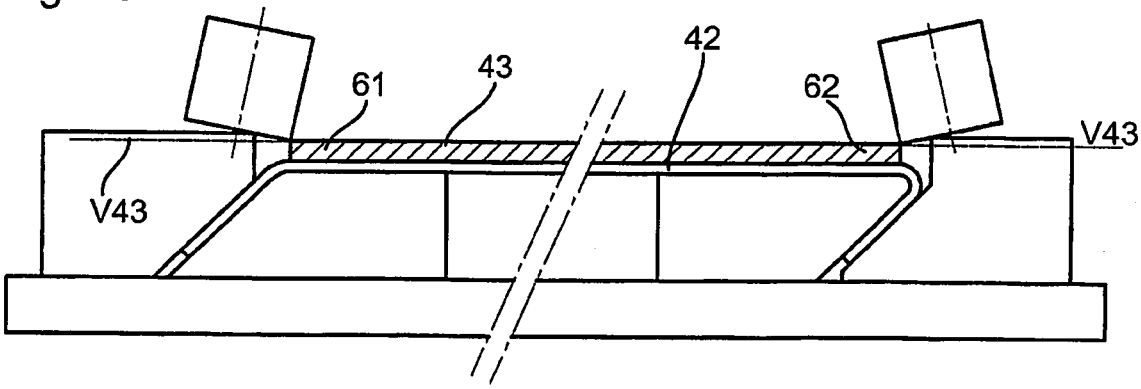
Figure 12:
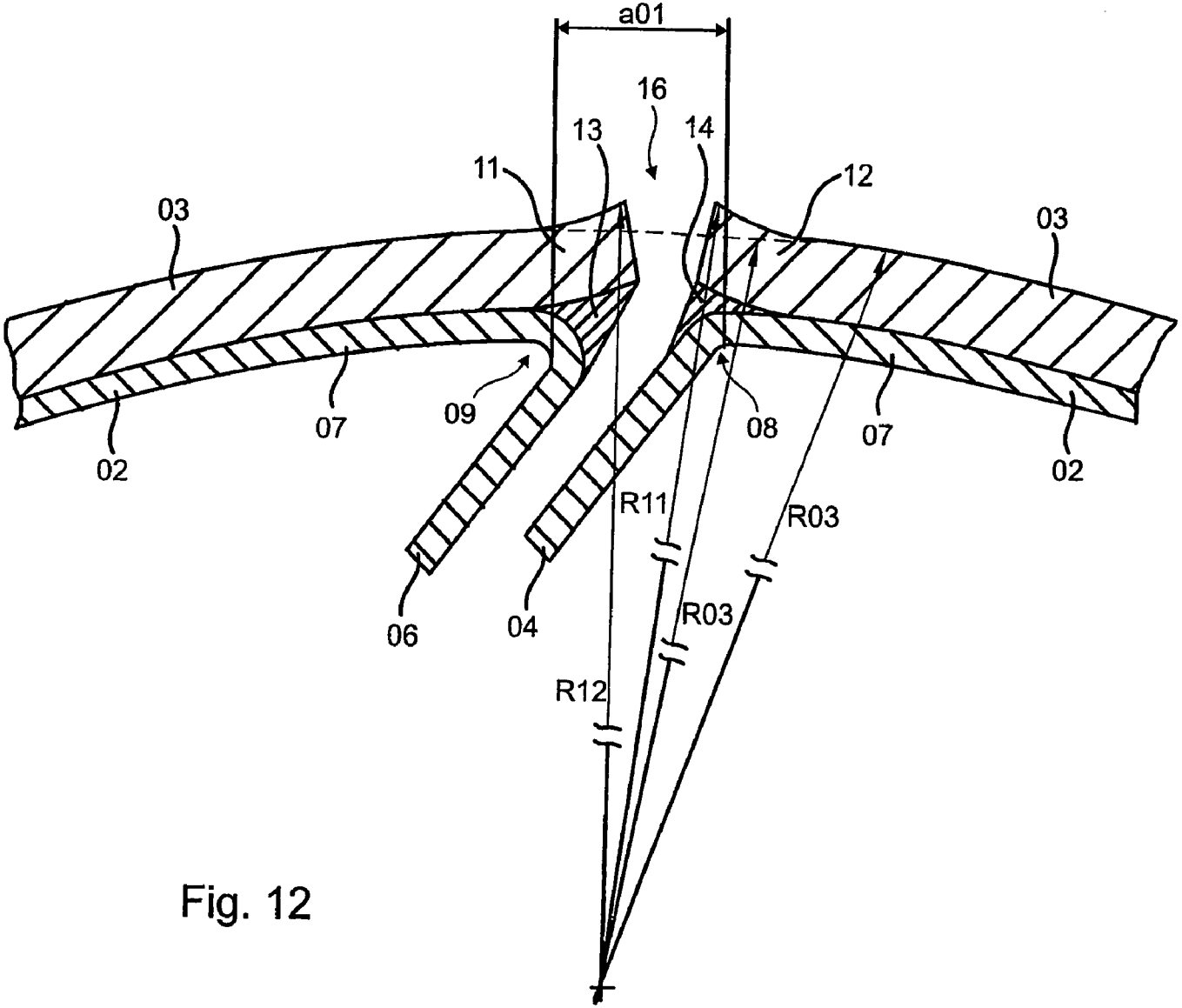

As represented in FIGS. 8, 11 and 12, the printing blanket unit 41 has at least one end 61 or 62 of a greater thickness than an area which is located between the two printing blanket ends 61 or 62, so that the outer surface of the printing blanket unit, in the area of this end 61 or 62, protrudes at least partially past the virtual extension V43 of the exterior of the printing blanket 43. In particular, this outer surface is embodied in a wedge shape. For thickening the end, the filler material 51, 52 is arranged at the ends of the printing blanket 43. In FIGS. 8 and 12, an undercoating of the printing blanket at 43 can be seen, while in FIG. 11, a filling of the printing blanket 43 is represented.

The embodiment with thickened ends in FIG. 8, in the state where it is mounted on the cylinder, correspondingly also applies to FIG. 11.

In the state where the printing blanket unit is mounted on the printing blanket cylinder, this thickened end, or both thickened ends extend in a radial direction past a virtual extension of the adjoining rubber blanket. An effective radius of the mounted rubber blanket is thus greater in the area of the ends. The area located inbetween is very much larger, and in particular is at least ten times greater, than the area of the ends. The thickening preferably extends in the circumferential direction by less than 10 mm, and in particular it extends less than 5 mm.

Accordingly, in the state where the printing blanket unit is mounted on the printing blanket cylinder, a radius R11 R12, as seen in FIG. 12 of the cylinder, in relation to the exterior of the printing blanket 03, or in relation to the outside of the filler material 13, 14, is greater, at least in the area of an end of the printing blanket unit, than a radius R03 of the cylinder, in relation to the exterior of the printing blanket, in the area between the two ends.

In accordance with all of the disclosed methods, the filler material 13, 14, 29, 51, 52 is introduced in a flowable, deformable state at least to one end of the two ends of the printing blanket unit. The filler material 13, 14, 29, 51, 52 is arranged, in the longitudinal direction, at least partially on a fold 08, 09, 27, 28, 48, 49 of the folded leg 04, 06, 21, 22, 44, 46 of the support plate 03, 18, 42 and protrudes, in the circumferential direction, past the fold 08, 09, 27, 28, 48, 49. After its application, the outside of the filler material 13, 14, 29, 51, 52 can be shaped to an appropriate exact size. Preferably, the filler material 13, 14, 29, 51, 52 can be embodied as one piece. The materials of the printing blanket 03, 04 and of the filler material 13, 14, 29, 51, 52 can be identical or they can be different.

As represented in FIG. 10, in a particularly preferred embodiment of the present invention, the length L51, L52 of the filler material 51, 52 is more than 0.1 mm, and in particular is more than 0.4 mm. However, this length is less than 2 mm, and in particular is less than 5 mm.

For producing printing blanket units, with printing blanket units which initially lie stretched out, either preferably flat or slightly arched, the filler material 51, 52, or the support elements 13, 14 or are is introduced at ends of the printing blanket unit facing away from each other, except for the preferred embodiment of FIG. 5.

A device 41 consisting of several parts, can be employed to produce the printing blanket unit, wherein at least two elements of the device 41, such as, for example, the slides 54, 56, are movable in relation to each other. In connection with this, it is possible, for example for use in producing thickened ends of the printing blanket unit, that at least the surface of the printing blanket, which is resting against the filler material 51, 52 protrudes, in the direction of the exterior of the printing blanket unit, at least partially past the virtual extension V43 of the exterior of the printing blanket 43, or that at least the surface of the printing blanket resting against the filler material 51, 52 protrudes in the direction of the exterior of the printing blanket unit at least partially past the virtual extension V42 of the exterior of the support plate 42 with the printing blanket 43 not yet applied to the support plate 42. The spacing between the two elements, for example between the two slides 54, 56, should be adjustable in the longitudinal direction of the printing blanket unit. At least one surface of one of the two elements, such as the slides 54, 56, rests against the filler material 51, 52, and at least one surface can rest against a folded leg 44, 46 of the support plate 42. At least the surface resting against the filler material 51, 52 can protrude, in the direction of the exterior of the printing blanket unit, at least partially past the virtual extension V43 of the exterior of the printing blanket 43. Alternatively, at least the surface of the printing blanket resting against the filler material 51, 52 can protrude in the direction of the exterior of the printing blanket unit at least partially past the virtual extension V42 of the exterior of the support plate 42 with the printing blanket 43 not yet applied to the support plate 42. At least one other device 58, such as, for example, a tool 58 for processing at least the outside of the filler material 51, 52, can be arranged on the device 41.

At least one support 53, such as, for example, the base body 53, should be arranged in the device 41 for use in receiving the support plate 42. The inside of the support plate 42 rests on this support 53.

The support 53 can consist of several elements. At least one element of the support 53 works together with a leading leg 46 of the support plate 42. Another element of the support 53 works with the trailing leg 44 of the support plate 42.

Preferably one element of the support 53 can change its position with respect to the other element of the support 53.

The device 41 can also have elements for folding the ends of the support plate 42. It can thus be embodied as a folding machine.

Embodiments wherein the support plate has only one folded leg are not specifically represented. In these cases, the filler material can be arranged on the fold of the one folded leg and on the other, non-folded end of the support plate.

The second end of the printing blanket unit is then not arranged in any groove. Instead it is positioned only on the exterior of the barrel of the printing blanket cylinder.

It applies to all of the above-described printing blanket units and methods, that the support or filler material 13, 14, 34, 36, 51, 52 is arranged, or can be arranged on the printing blanket unit, prior to the mounting of the printing blanket unit on the printing blanket cylinder.

The support or filler material 13, 14, 34, 36, 51, 52, can also be used, for example, for supporting a counter-cylinder in the radial direction, because the printing blanket cylinder is in contact with a counter-cylinder, such as, for example, a forme cylinder or a plate cylinder. The forme cylinder has at least one groove, in which at least one associated printing plate is fastened. In this case, the filler material 13, 14, 34, 36, 51, 52 works together with a printing plate of the counter-cylinder in that they mutually support each other.

While preferred embodiments of a printing blanket assembly for a blanket cylinder and methods for producing a printing blanket, in accordance with the present invention have been set forth fully and completely hereinabove, it will be apparent to one of skill in the art that various changes in, for example, the specific sizes of the printing blanket units, the specific structures used to retain them on the surface of a blanket or other cylinder, and the like could be made without departing from the true spirit and scope of the present invention which is accordingly to be limited only by the following claims.

What is claimed is:

1. A printing blanket unit adapted for use with a printing blanket cylinder of a rotary printing press comprising:

a dimensionally stable support plate including an exterior surface;

an angled leading end leg on a leading end of said support plate;

an angled trailing end leg on a trailing end of said support plate;

a leading end fold on said support plate between said leading end leg and said exterior surface;

a trailing end fold on said support plate between said trailing end leg and said exterior surface;

a printing blanket on said exterior surface and having blanket leading and trailing ends with inside end surfaces situated adjacent said leading and trailing end folds; and a filler material at said leading and trailing blanket ends between said leading and trailing end folds and said leading and trailing blanket inside end surfaces, said filler material acting as a support element wherein, in an installed position of said printing blanket unit on the printing blanket cylinder, said leading end filler material and said trailing end filler material, which are provided with lateral facing surfaces of a complimentary shape, are adjacent each other at a spacing distance of between 0.2 mm and 0.8 mm.

2. The printing blanket unit of claim 1 wherein at least one of said printing blanket leading and trailing inside end surfaces protrudes beyond an associated one of said leading and trailing end folds and wherein said filler material supports said at least one protruding inside end surface.

3. The printing blanket unit of claim 1 wherein a radius of said printing blanket unit in said installed position on the printing blanket cylinder at an exterior surface of said printing blanket is equal at said leading and trailing blanket ends and intermediate said leading and trailing blanket ends.

4. The printing blanket unit of claim 1 wherein in said installed position of said printing blanket unit on the printing blanket cylinder, said leading end filler material and said trailing end filler material are unconnected with each other and with an opposite end of said printing blanket unit.

5. The printing blanket unit of claim 4 wherein in said installed position, said leading end filler material and said trailing end filler material are out of contact with each other.

6. The printing blanket unit of claim 1 wherein said spacing distance is between 0.3 mm and 0.7 mm.

7. The printing unit blanket of claim 6 wherein said spacing distance is between 0.4 mm and 0.6 mm.

8. The printing unit blanket of claim 7 wherein said spacing distance is 0.5 mm.

9. The printing unit blanket of claim 1 wherein said blanket leading and trailing ends are produced from a workpiece by cutting.

10. The printing unit blanket of claim 1 wherein at least one of said leading and trailing end folds has a radius of between 0.3 mm and 0.7 mm.

11. The printing blanket unit of claim 10 wherein said radius is 0.5 mm.

12. The printing blanket unit of claim 1 wherein at least one of said leading and trailing end folds has a radius of between 0.6 mm and 1.2 mm.

13. The printing blanket unit of claim 12 wherein said radius is 0.8 mm.

14. The printing blanket unit of claim 1 wherein a length of each of said filler materials, in a circumferential direction of the printing blanket cylinder is between 0.4 mm and 1.0 mm.

15. The printing blanket unit of claim 1 wherein a length of each of said filler materials, in a circumferential direction of the printing blanket cylinder is between 0.1 mm to 1.3 mm.

16. The printing blanket unit of claim 15 wherein said length is 0.7 mm.

17. The printing blanket unit of claim 1 wherein said filler material extends in a radial direction of the printing blanket cylinder past a vertical extension of said support plate exterior surface.

18. The printing blanket unit of claim 1 wherein said leading and trailing end folds are enclosed by said filler material.

19. The printing blanket unit of claim 1 wherein said support plate is steel.

20. The printing blanket unit of claim 1 wherein said printing blanket is multi-layered.

21. The printing blanket of claim 1 wherein said printing blanket is a first material and said filler material is a second material different from said first material.

22. The printing blanket unit of claim 1 wherein said printing blanket is a first material and said filler material is said first material.

23. The printing blanket unit of claim 1 wherein said printing blanket is situated on top of said filler material.

24. A printing blanket unit adapted for use with a printing blanket cylinder of a rotary printing press comprising:

a dimensionally stable support plate including an exterior surface;

an angled leading end leg on a leading end of said support plate;

an angled trailing end leg on a trailing end of said support plate;

a leading end fold on said support plate between said leading end leg and said exterior surface;

a trailing end fold on said support plate between said trailing end leg and said exterior surface;

a printing blanket on said exterior surface and having blanket leading and trailing ends with inside end surfaces situated adjacent said leading and trailing end folds; and a filler material at said leading and trailing blanket ends between said leading and trailing end folds and said leading and trailing blanket inside end surfaces, said filler material acting as a support element, said printing blanket having at least one of said leading and trailing blanket ends of a first, end thickness and a central area located between said leading and trailing ends of a second, central area thickness, said first thickness being greater than said second thickness, whereby an exterior of said printing blanket unit at said end with said first end thickness extends in a radial direction of said printing blanket cylinder past a virtual extension of said central area of said printing blanket unit.

25. A printing blanket unit adapted for use with a printing blanket cylinder of a rotary printing press comprising:

a dimensionally stable support plate including an exterior surface;

an angled leading end leg on a leading end of said support plate;

an angled trailing end leg on a trailing end of said support plate;

a leading end fold on said support plate between said leading end leg and said exterior surface;

a trailing end fold on said support plate between said trailing end leg and said exterior surface;

a printing blanket on said exterior surface and having blanket leading and trailing ends with inside end surfaces situated adjacent said leading and trailing end folds; and a filler material at said leading and trailing blanket ends between said leading and trailing end folds and said leading and trailing blanket inside end surfaces, said filler material acting as a support element, said filler material beings secured to said printing blanket prior to the mounting of said printing blanket on said support plate.

* * * * *